US010807622B2

(12) United States Patent
Ginis et al.

(10) Patent No.: US 10,807,622 B2
(45) Date of Patent: Oct. 20, 2020

(54) TRACKSIDE CONTROLLER OF AT LEAST ONE PIECE OF TRACKSIDE EQUIPMENT OF A RAILWAY NETWORK AND RELATED RAILWAY SYSTEM

(71) Applicant: ALSTOM Transport Technologies, Saint-Ouen (FR)

(72) Inventors: Guillaume Ginis, Cour-sur-Heure (BE); Julien Mulpas, Ghlin (BE)

(73) Assignee: ALSTOM Transport Technologies, Saint-Ouen (FR)

( * ) Notice: Subject to any disclaimer, the term of this patent is extended or adjusted under 35 U.S.C. 154(b) by 509 days.

(21) Appl. No.: 15/715,436

(22) Filed: Sep. 26, 2017

(65) Prior Publication Data

US 2018/0086356 A1 Mar. 29, 2018

(30) Foreign Application Priority Data

Sep. 28, 2016 (FR) ..... 16 59170

(51) Int. Cl.
*B61L 19/06* (2006.01)
*B61L 7/06* (2006.01)

(52) U.S. Cl.
CPC ..... *B61L 19/06* (2013.01); *B61L 7/06* (2013.01); *B61L 2019/065* (2013.01)

(58) Field of Classification Search
CPC ..... B61L 19/06; B61L 17/06; B61L 2019/065
USPC ..... 246/131
See application file for complete search history.

(56) References Cited

U.S. PATENT DOCUMENTS

2009/0143928 A1* 6/2009 Ghaly ..... B61L 19/06 701/19
2015/0142225 A1* 5/2015 Tonguz ..... B61L 19/06 701/19
2015/0210303 A1* 7/2015 Seidler ..... B61L 11/00 701/19
2016/0046306 A1* 2/2016 Miyajima ..... B60L 15/40 701/19
2016/0060036 A1* 3/2016 Nakade ..... B65G 1/137 701/19
2017/0210402 A1* 7/2017 Echizen ..... B61L 19/06
(Continued)

FOREIGN PATENT DOCUMENTS

EP 2347943 A2 7/2011
EP 2998185 A1 3/2016
(Continued)

OTHER PUBLICATIONS

French Search Report dated May 29, 2017, issued in corresponding French Application FR1659170.

*Primary Examiner* — Jason C Smith
(74) *Attorney, Agent, or Firm* — Troutman Pepper Hamilton Sanders LLP

(57) ABSTRACT

This trackside controller for at least one piece of trackside equipment of a railway network, comprising a processor, a memory unit associated with the processor, and at least one communication port configured to be directly connected to the piece of trackside equipment. The memory unit comprises an area dedicated to storing a logic object representative of said at least one piece of trackside equipment, the logic object being executable by the processor and comprising a plurality of logic rules defining the operation of said at least one piece of trackside equipment.

10 Claims, 4 Drawing Sheets

(56) References Cited

U.S. PATENT DOCUMENTS

| | | | | |
|---|---|---|---|---|
| 2018/0086356 | A1* | 3/2018 | Ginis | B61L 19/06 |
| 2018/0281831 | A1* | 10/2018 | Adomeit | B61L 19/06 |
| 2018/0370551 | A1* | 12/2018 | Hou | B61L 21/04 |
| 2019/0329805 | A1* | 10/2019 | Fang | B61L 19/14 |
| 2020/0047784 | A1* | 2/2020 | Harsch | B61L 7/06 |

FOREIGN PATENT DOCUMENTS

| | | | |
|---|---|---|---|
| WO | 2008/141706 | A1 | 11/2008 |
| WO | 2013/117398 | A2 | 8/2013 |
| WO | 2015/101610 | A1 | 7/2015 |

* cited by examiner

TRACKSIDE CONTROLLER OF AT LEAST ONE PIECE OF TRACKSIDE EQUIPMENT OF A RAILWAY NETWORK AND RELATED RAILWAY SYSTEM

CROSS-REFERENCE TO RELATED APPLICATIONS

This application is based upon and claims the benefit of priority of the prior French Patent Application No. FR 16 59170, filed on Sep. 28, 2016, the entire contents of which are incorporated herein by reference.

FIELD OF THE INVENTION

The present invention relates to a trackside controller for at least one piece of trackside equipment of a railway network, comprising a processor, a memory unit associated with the processor, and at least one communication port configured to be directly connected to the piece of trackside equipment.

The present invention also relates to a railway supervision system comprising at least one interlocking system, at least one piece of trackside equipment of a railway network and at least one trackside controller for at least one piece of trackside equipment of a railway network.

The present invention more particularly relates to an automatic train supervision (ATS) architecture. The ATS system is implemented in an operational unit and comprises man/machine interfaces, allowing operators to intervene on the various systems of the signaling system and, in particular, the trackside equipment. For example, the operator can remotely control the closing of a signal (turning a light red), or closing a crossing gate, from the ATS.

BACKGROUND

The signaling system also comprises an interlocking system. Such an interlocking system, often centralized and remote, is able to manage the trackside equipment, such as signals, points, etc., that trackside equipment allowing the trains to move safely and making it possible to avoid conflicting movements between the trains.

Once based on electromechanical relays, today the interlocking system is computerized by computers able to command the trackside equipment, via trackside controllers located on the track.

Such trackside controllers of trackside equipment convert the input data received from the interlocking system into an action to be performed by the corresponding piece of trackside equipment and back up the status of the piece of trackside equipment to the interlocking system.

In other words, these trackside controllers of trackside equipment are basic information relays between the interlocking system, which is often centralized and remote, and the trackside equipment.

The current trackside controllers, subsequently called basic controllers, are not configurable and do not have any logic component other than that or those necessary to convert data transmitted by the interlocking system into an order to be carried out by the trackside equipment.

For example, currently, the interlocking system decides when to turn on one of the bulbs of a signal, sends the illumination command to the trackside controller located near the signal whereof one bulb is to be illuminated, then the trackside controller powers on the bulb indicated by the interlocking system.

Such a supervision architecture for the trackside equipment has high reaction times, which limits the interlocking reactivity of the trackside equipment.

Furthermore, when the communication between the interlocking system and the trackside controllers is downgraded, for example due to saturation of the processing capacities of the interlocking system, or interrupted, the operation of the trackside equipment becomes impossible, no longer allowing trains to move safely.

SUMMARY

The aim of the invention is therefore to propose a trackside controller for trackside equipment having improved autonomy, while retaining the current automatic train supervision architecture.

To that end, the invention relates to a trackside controller of the aforementioned type, wherein the memory unit comprises an area dedicated to storing a logic object representative of said at least one piece of trackside equipment, the logic object being executable by the processor and comprising a plurality of logic rules defining the operation of said at least one piece of trackside equipment and at least two logic blocks representative of two separate parts of said at least one piece of trackside equipment and/or two separate pieces of trackside equipment.

According to other advantageous aspects of the invention, the trackside controller comprises one or more of the following features, considered alone or according to all technically possible configurations:

- the processor is configured to execute the logic object from at least one input datum provided by at least one device associated with the trackside controller belonging to the group comprising:
  - an interlocking system,
  - a piece of trackside equipment,
  - another trackside controller;
- the trackside controller comprises a module for defining and/or configuring the logic object;
- at least one of the logic rules comprises at least two logic operators;
- the processor is configured to successively execute at least two logic rules of the plurality of logic rules associated with the logic object representative of the piece of trackside equipment;
- the trackside controller comprises a timer associated with the processor configured to execute a second logic rule after the first logic rule once a time delay, separating the execution of the first and second logic rules, has elapsed; and
- the processor is configured to simultaneously execute at least two logic rules of the plurality of logic rules associated with the logic object representative of the piece of trackside equipment.

The invention also relates to a railway supervision system comprising at least one interlocking system, at least one piece of trackside equipment of a railway network and at least one trackside controller for at least one piece of trackside equipment of a railway network, the trackside controller comprising a housing inside which the processor and the memory unit are arranged, the interlocking system being outside the housing of the trackside controller, in which the trackside controller is as defined above.

According to another advantageous aspect of the invention, the railway supervision system comprises the following feature:

the piece of trackside equipment belongs to the group comprising at least:

a signal, a switching actuator, a crossing, a track circuit, and a sound signal.

BRIEF DESCRIPTION OF THE DRAWINGS

The features and advantages of the invention will be better understood upon reading the following description, provided solely as a non-limiting example, and done in reference to the appended drawings, in which.

DETAILED DESCRIPTION

Figure 1:
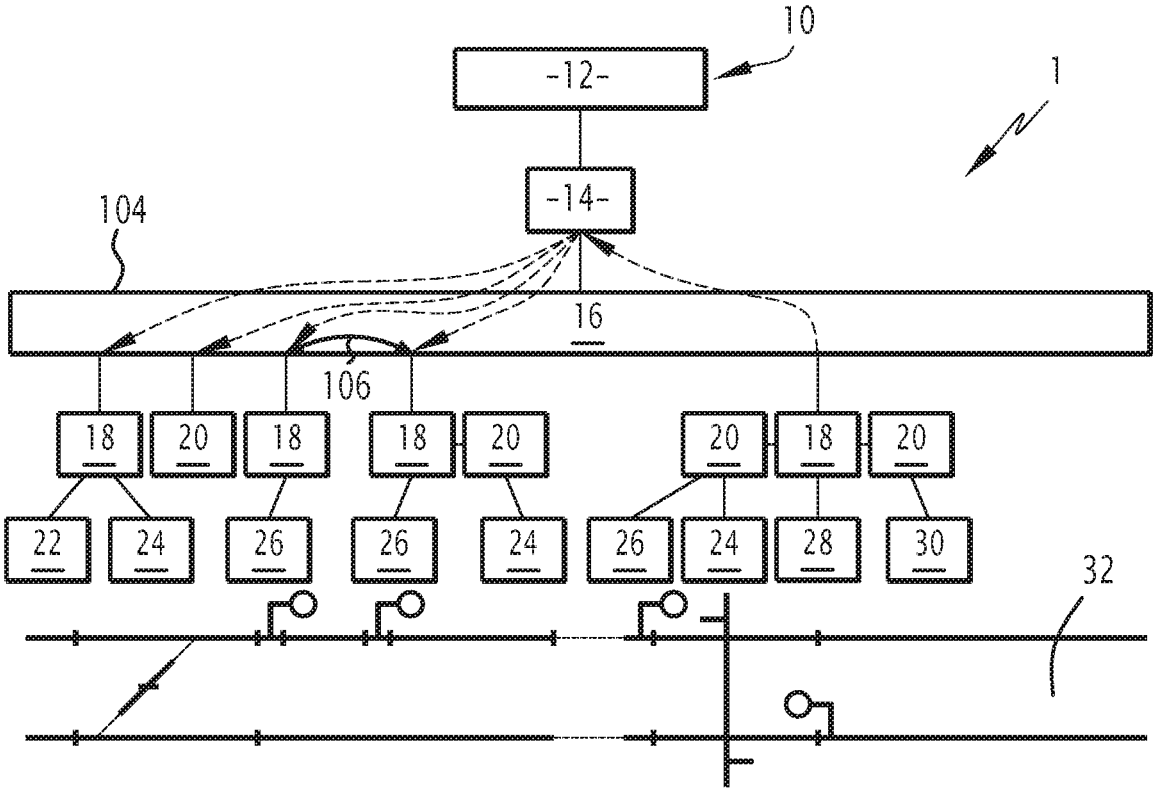
FIG. 1 is a schematic illustration of railway supervision system according to the invention, comprising several pieces of trackside equipment, an interlocking system and at least one trackside controller according to the invention, connected to one another via a network.

In FIG. 1, a railway supervision system 1 is configured to supervise a railway track 32 in the presence or absence of a railway vehicle, not shown, and comprises several pieces of trackside equipment, such as points 22, a track circuit 24, signals 26, a level crossing 28, local control buttons 30, etc.

The railway supervision system 1 also comprises trackside controllers 18, 20 configured to control the aforementioned pieces of trackside equipment.

According to the example of FIG. 1, the railway supervision system comprises two types of trackside controllers, i.e., trackside controllers according to the prior art, subsequently called "basic" trackside controllers 20, and trackside controllers according to the invention, called "advanced" trackside controllers 18.

The trackside controllers, irrespective of their type, are configured to communicate, via communication links 104, for example an Ethernet link, of a network 16, such as a local network with a control center 10 (also called signal boxes). The control center 10 in particular comprises a train management system 12 and an interlocking system 14.

"Trackside controller" hereinafter refers to an electronic device housed in its own housing, the trackside controller also being configured to be directly connected to the piece(s) of trackside equipment that it controls autonomously according to the invention.

In other words, the trackside controller according to the invention comprises at least one communication port to be connected via a link, for example wired, to the piece(s) of trackside equipment with which it is associated.

The interlocking system 14 is configured to manage the trackside controllers 18 and 20. The interlocking system 14 is for example made in computer form by computers suitable for commanding the trackside equipment, via the aforementioned trackside controllers.

In particular, to manage a basic trackside controller 20 according to the prior art, the interlocking system 14 comprises a logic unit, not shown, which, depending on the current railway situation, generates commands intended to be executed by a basic trackside controller according to the prior art configured to activate all or some of the trackside equipment useful for managing the current railway situation.

Consequently, in the absence of communication with the interlocking system 14 via the network 16, the basic trackside controller 20 is, by default, in the so-called "secure" mode requiring the trackside equipment 22, 24, 26, 28 and 30 to be in a configuration not authorizing trains to pass. In other words, the basic trackside controller 20 depends on the quality of the link connecting the interlocking system 14 to the control center.

Figure 2:
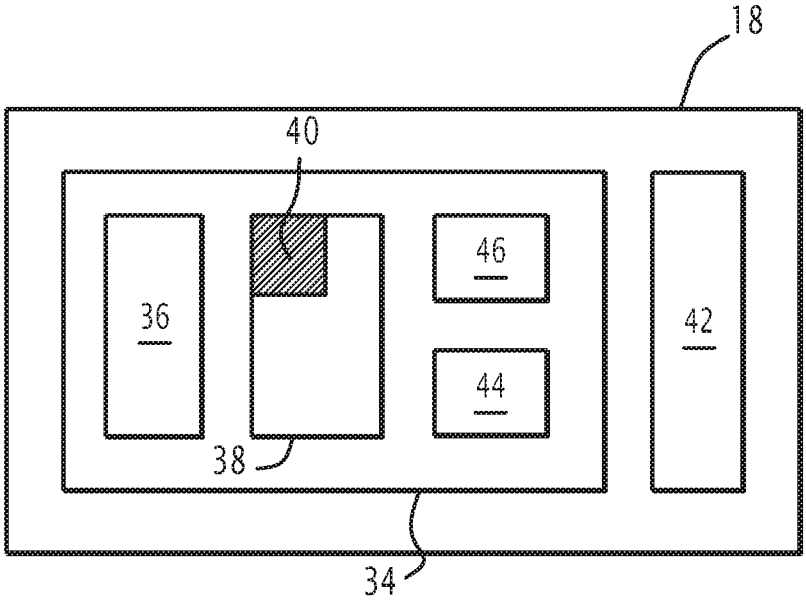
FIG. 2 is a schematic illustration of one of the trackside controllers of FIG. 1.

By comparison, the advanced trackside controller 18 according to the invention, shown in FIG. 2, comprises an information processing unit 34 for example formed by a processor 36 arranged inside the housing, the housing making it possible to protect the information processing unit 34 from impacts or bad weather.

The processor 36 is known in itself, and is also called CPU (Central Processing Unit). The processor 36 is for example a microprocessor. Alternatively, the processor 36 includes one or several programmable components.

The information processing unit 34 is also formed by a memory unit 38 associated with the processor 36, the memory unit 38 including a zone 40 dedicated to storing at least one logic object representative of at least one of the aforementioned pieces of trackside equipment 22, 24, 26, 28 and 30, the logic object being executable by the processor 36 and comprising a plurality of logic rules defining the operation of the associated piece of trackside equipment.

For example, as illustrated by FIG. 1, the memory unit 38 of the advanced trackside controller 18 comprises a zone 40 dedicated to storing a first logic object corresponding to a point 22 and storing a second logic object corresponding to a track circuit 24.

According to another example also illustrated in FIG. 1, the memory unit 38 of the advanced trackside controller 18 comprises a zone 40 dedicated to storing a first logic object corresponding to a level crossing 28.

In other words, this zone 40 of the memory unit 38 of the advanced trackside controller 18 is able to allow increased autonomy of the advanced trackside controllers 18 relative to the basic trackside controllers 20, and a smaller burden for the interlocking system 14.

More specifically, such an implementation of the memory unit 38 of the advanced trackside controller 18 is able to offload the logic processing, previously implemented only in the interlocking system 14, to the advanced trackside controller 18, which amounts to decentralizing this logic processing at the advanced trackside controller 18.

According to a first alternative shown in FIG. 2, the advanced trackside controller 18 comprises a transceiver module 42 configured in particular to receive the logic object(s) representative of trackside equipment. In other words, according to this alternative, the advanced trackside controller 18 is configured to receive a logic object previously configured and executable by the processor 36.

Furthermore, the transceiver module 42 of the advanced trackside equipment 18 is able to receive one or several data supplied by at least one device associated with the advanced trackside controller 18 belonging to the group comprising:

the interlocking system 14;

a nearby piece of trackside equipment 22, 24, 26, 28 and 30; and another advanced 18 or basic 20 trackside controller.

The transceiver module 42 of the advanced trackside controller 18 is also able to emit, automatically and autonomously, one or several commands for the piece(s) of trackside equipment with which it is associated.

According to a second alternative, shown in FIG. 2, and able to be combined with the first alternative, the advanced trackside controller 18 also comprises a definition and/or configuration module 44 (also called configuration media or configuration key) for logic rules associated with a logic object configured to allow a reconfiguration of the logic object. According to one particular aspect, such a definition and/or reconfiguration module is removable.

Indeed, the railway traffic and/or signaling rules varying from one country to another, the presence of such a definition and/or configuration module 44 makes it possible to adapt the control of the trackside equipment based on the rules in force and based on the types of trackside equipment available.

For example, in a high-traffic urban setting, one will find a first level passage category comprising a full gate or two partial gates, a remote road signal, and a close signal with two blinking red lights and a lunar white light. A second level passage category for example corresponds to the replacement of the full gate or two partial gates of the level passage of the first category with a single partial gate on the right side in the direction of travel.

The definition and/or configuration module 44 is able to allow the addition/deletion of logic rules. The modularity of the management of the operation of the trackside equipment is thus increased.

According to a first option, such a configuration adaptation is carried out remotely using tools associated with the interlocking system 14 or, according to a second option, locally by an operator during a maintenance operation.

According to one particular aspect, the advanced trackside controller 18 according to the invention, shown in FIG. 2, also comprises one or several timers 46 associated with the processor 36 configured to execute a second logic rule after a first logic rule once a time delay, separating the execution of the first and second logic rules, has elapsed.

One example embodiment of the logic object(s) stored in the zone 40 of the memory unit 38 will now be described using FIGS. 3 and 4, respectively showing, for one example application of the invention, a flowchart of information exchanges as a function of time t between an interlocking system 14 and the basic trackside controller 20, and a flowchart of information exchanges as a function of time t between an interlocking system 14 and advanced trackside controllers 18 according to the invention.

The example application is in particular the railway situation corresponding to the passage of a train 110 on a track 32 comprising three successive zones respectively associated with three separate track circuits CV0, CV1 and CV2, and three signals S1, S2 and S3.

Figure 3:
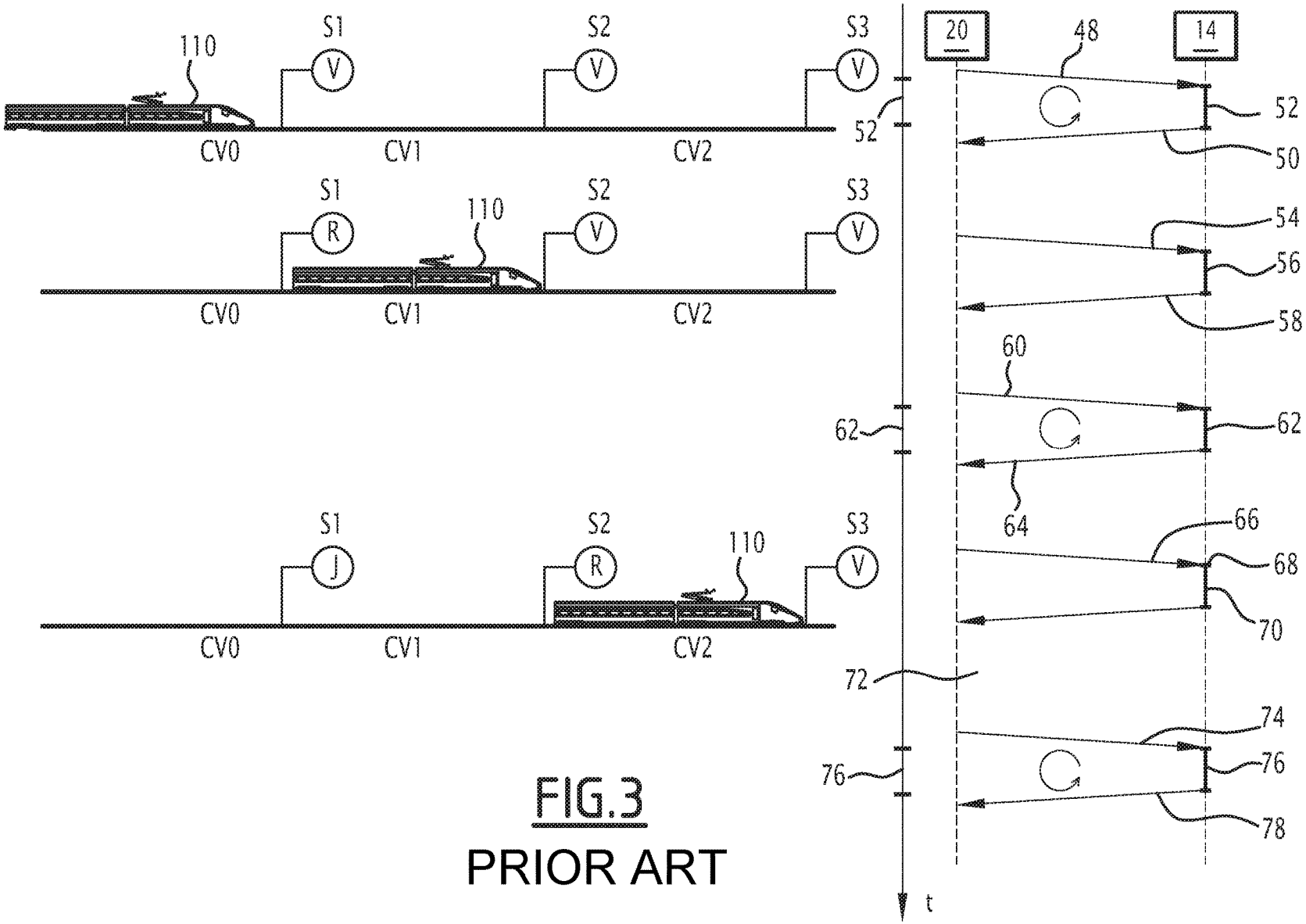
FIG.3 PRIOR ART
FIG. 3 is a flowchart of exchanges between a trackside controller according to the prior art and an interlocking system for one example application of the invention.
Figure 4:
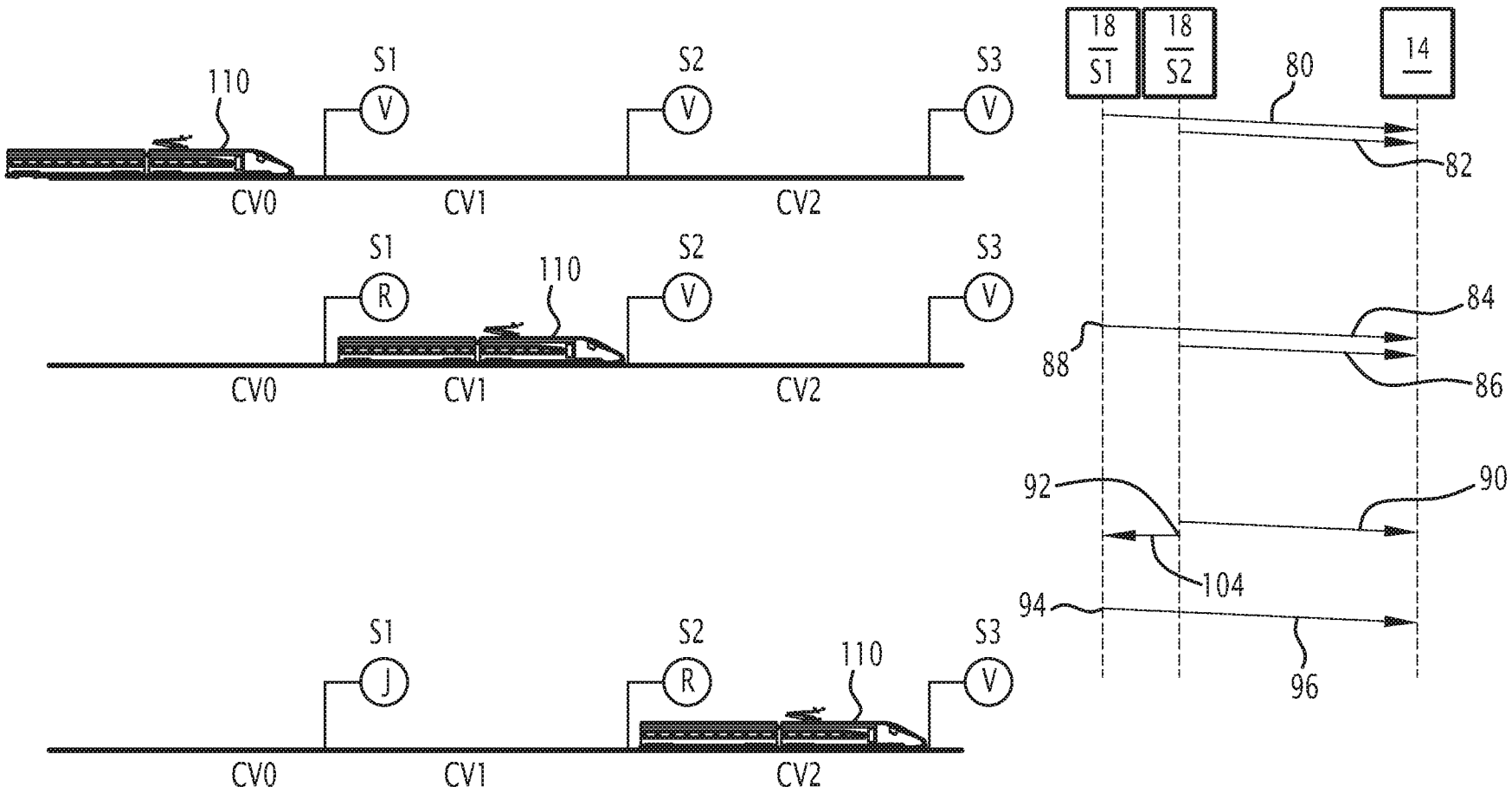
FIG. 4 is a flowchart of exchanges between a trackside controller according to the invention and an interlocking system for the application of FIG. 3.

Comparing FIGS. 3 and 4 shows that the advanced trackside controllers 18 according to the invention, relative to the basic trackside controllers 20, can make it possible to limit the interactions with the interlocking system 14 and also to allow a reduction in the reaction time of the trackside equipment.

Improved track safety is therefore obtained, since the reactivity of the trackside equipment is increased.

More specifically, according to the prior art as illustrated by FIG. 3, the railway situation corresponding to the passage of a train 110 on a track 32 comprising three successive zones respectively associated with three separate track circuits CV0, CV1 and CV2, and three signals S1, S2 and S3 is managed as described below by the interlocking system 14 and the basic trackside controller 20.

During step 48, the basic trackside controller 20 sends the statuses of the track circuits CV0, i.e., occupied for the circulation of the train 110, CV1 and CV2, i.e., free, and the signals S1 to S3, i.e., green V.

During the entire circulation period 52 of the train 110 on the track circuit CV0, the interlocking system 14 requires, according to step 50, that the basic trackside equipment 20 update and maintain these statuses of the track circuits CV0 to CV2, and signals S1 to S3.

During step 54, the basic trackside controller 20 sends the statuses of the track circuits CV0, i.e., free, CV1, i.e., occupied for the circulation of the train 110, and CV2, i.e., free, and confirms that the status of the signals S1 to S3 was indeed green as required by the interlocking system 14.

During step 56, the interlocking system 14 conducts a logic analysis of these statuses returned by the basic trackside controller 20, then decides, during step 56, to change the status of the signal S1 from green V to red R.

During step 58, the interlocking system 14 then requires that the basic trackside controller 20 activates the color change of the signal S1 from green V to red R.

The basic trackside controller 20 executes this status change command of the signal S1 from green V to red R emitted by the interlocking system 14, and during step 60, confirms this status change to the interlocking system 14.

During the entire circulation period 62 of the train 110 on the track circuit CV1, the interlocking system 14 requires 64 that the basic trackside equipment 20 update and maintain these statuses of the track circuits CV0 to CV2, and signals S1 to S3.

During step 66, the basic trackside controller 20 sends the statuses of the track circuits CV0 and CV1, i.e., free, and CV2, i.e., occupied for the circulation of the train 110, and confirms that the status of the signals S2 and S3 was indeed green while that of the signal S1 was indeed red, as required by the interlocking system 14.

During step 68, the interlocking system 14 conducts a logic analysis of these statuses returned by the basic trackside controller 20, and decides, during step 68, to change the status of the signal S2 from green V to red R, then decides, during step 70, to change the status of the signal S1 from red R to yellow J.

During step 72, the interlocking system 14 then requires that the basic trackside controller 20 activates the corresponding color changes of the signals S1 and S2.

During step 74, the basic trackside controller 20 sends the statuses of the track circuits CV0 and CV1, i.e., free, and CV2, i.e., occupied for the circulation of the train 110, and confirms the status of the signals S1 to S3, i.e., yellow, red, green, respectively.

During the entire circulation period 76 of the train 110 on the track circuit CV2, the interlocking system 14 requires, during step 78, the updating and maintenance of these statuses of the track circuits CV0 to CV2, and signals S1 to S3.

Thus, according to the prior art, the management of the railway situation corresponding to the passage of a train 110 on a track 32 comprising three successive zones respectively associated with three separate track circuits CV0, CV1 and CV2, and three signals S1, S2 and S3 by the interlocking system 14 and the basic trackside controller 20 requires no fewer than ten exchanges and as many analysis steps as there are track circuits CV0 to CV2.

The reaction time necessary to manage this railway situation in complete safety corresponds to the cumulative total of these exchange and analysis times, and as a direct consequence, limits the speed of the train.

FIG. 4 shows the management of the same railway situation as that illustrated by FIG. 3, with the sole difference that the basic trackside controller 20 executing the orders from the interlocking system 14 of the pieces of trackside equipment CV0 to CV2 and S1 to S3 is replaced, for example, by two advanced trackside controllers 18 according to the invention respectively associated with the signals S1 and S2.

More specifically, owing to the zone 40 dedicated to storing logic objects corresponding to the signals S1 and S2 of each advanced trackside controller 18, respectively, the interlocking system 14 no longer carries out the analysis, command and decision emission steps relative to the signals S1 and S2 previously described in relation to FIG. 3.

Indeed, these analysis and command and decision emission steps are henceforth implemented locally within the advanced trackside controllers 18, whose respective processors are configured to execute the logic objects stored in their memory.

Thus, the two advanced trackside controllers 18 according to the invention respectively associated with the signals S1 and S2 each time return the statuses of the track circuits CV0 to CV2 and the statuses of the signals S1 and S2 to the interlocking system 14 and completely autonomously manage the color changes of the signal with which they are associated as the train advances.

More specifically, during the circulation of the train 110 on the track CV0, the two advanced trackside controllers 18 according to the invention respectively associated with the signals S1 and S2 return, to the interlocking system 14, respectively, during steps 80 and 82, the free status of the zones of the railway track 32 associated with the track circuits CV1 and CV2 and the statuses of the signals S1 and S2.

During the circulation of the train 110 on the track CV1, the two advanced trackside controllers 18 according to the invention respectively associated with the signals S1 and S2 return, to the interlocking system 14, respectively, during steps 84 and 86, the occupied status of the zone of the railway track 32 associated with the track circuit CV1 and the free status of the zone of the railway track 32 associated with the track circuit CV2.

Furthermore, from the logic input corresponding to the occupancy information sent by the track circuit CV1, the processor 36 of the advanced trackside controller 18 associated with the signal S1 executes 88 the logic rules associated with the logic object corresponding to the signal S1 and uses these logic rules to determine, during a step 88, the relevant moment to implement the color change from green V to red R of the bulb of the signal S1.

Similarly, during the circulation of the train 110 on the track CV2, the advanced trackside controller 18 associated with the signal S2 returns, during step 90, the occupied status of the zone of the railway track 32 associated with the track circuit CV2 to the interlocking system 14 on the one hand, and returns, during step 104, this same occupied status of the zone of the railway track 32 associated with the track circuit CV2 to the advanced trackside controller 18 associated with the signal S1, on the other hand.

Simultaneously or successively with respect to the return of this status, the processor 36 of the advanced trackside controller 18 associated with the signal S2 executes, during step 92, the logic rules associated with the logic object corresponding to the signal S2 and uses these logic rules to determine, during step 92, from the logic input corresponding to the occupancy information transmitted by the track circuit CV2, the relevant moment to implement the color change from green V to red R of the bulb of the signal S1.

Simultaneously or successively with respect to the return of this status, the processor 36 of the advanced trackside controller 18 associated with the signal S1 executes, during step 94, the logic rules associated with the logic object corresponding to the signal S1 and uses these logic rules to determine, during step 94, from the logic input corresponding to the occupancy information transmitted by the advanced trackside controller 18 associated with the signal S2, the relevant moment to implement the color change from red R to yellow J of the bulb of the signal S1.

Once step 94 is carried out, the advanced trackside controller 18 associated with the signal S1 returns, during step 96, the free status of the zone of the railway track 32 associated with the track circuit CV1 to the interlocking system 14.

Thus, compared with FIG. 3 relative to the implementation of basic trackside controllers according to the prior art, the use of the advanced trackside controllers 18 allows a redistribution of the roles respectively played by the advanced trackside controllers 18 and the interlocking system 14.

In other words, the interlocking system 14 is able to provide and/or receive, from the advanced trackside controller, higher-level instructions corresponding to a desired status of the zones of the track without specifying the implementation moment of the implementation steps to be applied, which are determined by the advanced trackside controller 18 with complete autonomy. As illustrated by FIG. 4, the controllers manage the signals S1 and S2 with complete autonomy, which decreases the burden of the interlocking system 14.

The interlocking system 14 is able to detect the type of trackside controller with which it exchanges and, based on this type, activates/deactivates all or some of its logic unit so as not to have to process the operation of the trackside equipment handled by the advanced trackside controllers 18 according to the invention.

As previously described in relation to FIG. 4, an advanced trackside controller 18 according to the invention is not only configured to exchange with the interlocking system 14, but also with another advanced trackside controller 18 or with a basic trackside controller 20 as shown in FIG. 1.

Furthermore, the advanced trackside controller itself fully autonomously manages the status of the signals without continuously requiring commands from the interlocking system 14. The number of exchanges with the interlocking system 14 in the vicinity of ten exchanges in FIG. 3 is in fact reduced to six exchanges in FIG. 4.

Owing to the autonomy of the advanced trackside controllers according to the invention, the reaction time of the trackside equipment is reduced, allowing improved safety of the railway tracks. Furthermore, in case of downgraded mode corresponding to a communication defect between the interlocking system 14 and the trackside controllers, the management of the signals handled by the advanced trackside controllers shown in FIG. 4 will remain unchanged.

An example logic object structure stored in the dedicated zone 40 of the memory unit 38 of an advanced trackside controller 18 according to the invention is described below, as well as its execution by the processor 36.

According to one particular aspect of the invention, a logic object allows management of the operation of a plurality of pieces of trackside equipment and not a single piece of trackside equipment and is, to that end, made up of logic blocks representative of parts of pieces of trackside equipment and/or separate pieces of trackside equipment making up a specific railway situation.

Figure 5:
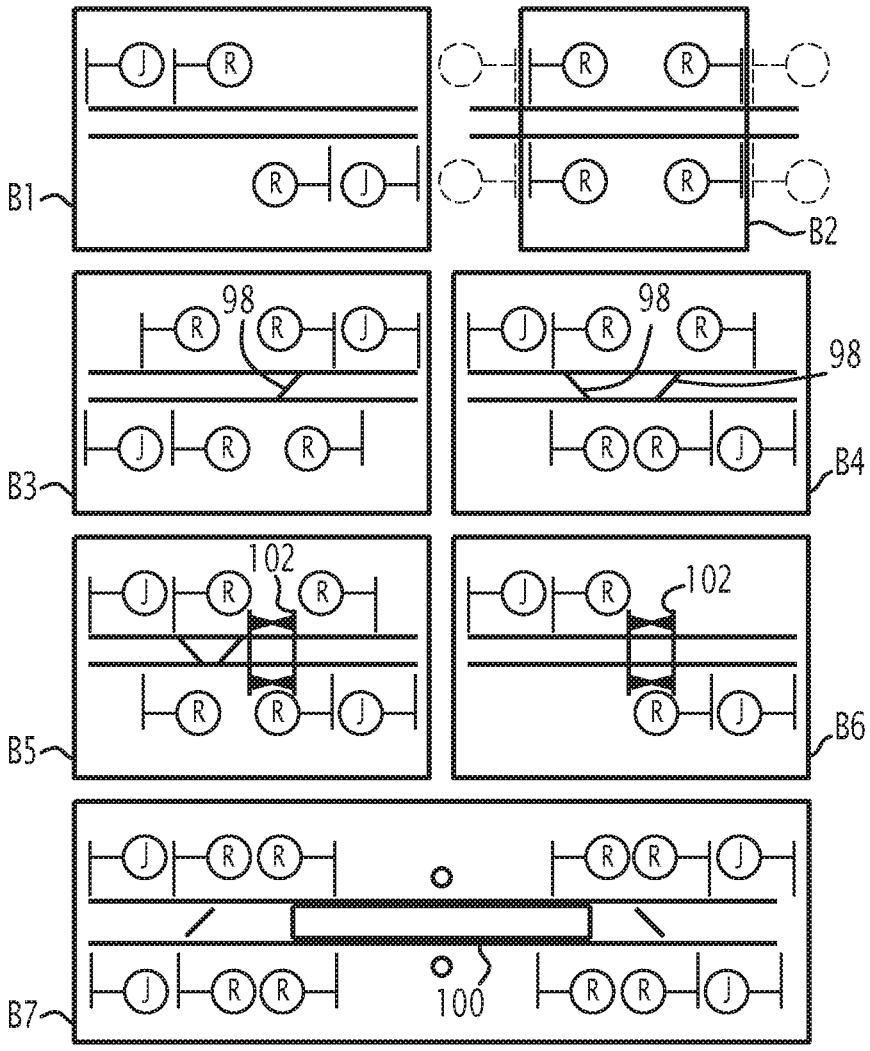
FIG. 5 shows different logic blocks associated with different pieces of trackside equipment.

Non-limiting examples of logic blocks are shown in FIG. 5. These logic blocks correspond to different railway situations:

- logic block B1 corresponds to the logic management of signals of two sections on two tracks going in opposite directions,
- logic block B2 corresponds to the logic management of two sections on two tracks going in opposite directions for which it is possible to manage both travel directions owing to the signals,
- logic block B3 corresponds to block B2 in which two switches allowing passage from one track to the other, i.e., from left on the track in the bottom right to the top track and vice versa, are added,
- logic block B4 corresponds to block B2 in which four switches allowing passage from one track to the other independently of the travel direction are taken into account,
- logic block B5 corresponds to block B4 in which the position of the two switches 98 is modified relative to the railway situation managed by block B4 and in which the logic management of a level passage 102 is also handled,
- logic block B6 corresponds to logic block B1 in which the logic management of a level passage 102 is also handled,
- logic block B7 corresponds to the logic management of a train station with an open line where a train 100 is circulating, with the logic management of twelve signals (eight red and four yellow located symmetrically relative to the track 32) and two switches 98 as well as platform departure buttons 10T.

Thus, the logic blocks previously described illustrate the possibility, to form a complex logic object, of interleaving/combining/repeating different available logic blocks such as activatable/deactivatable elements (i.e., logic bricks) of a logic library stored in the memory unit 38 of the advanced trackside controller 18 according to the invention. Railway management modularity by the advanced trackside controllers 18 is thus obtained, allowing the management of complex railway situations.

Subsequently, a logic object (or logic block when it is combined with other logic blocks to form a logic object of higher complexity than a logic block) corresponding to a level passage 102 with two barriers stored in the dedicated zone 40 of the memory unit is described.

Such a logic object corresponding to a level passage is for example characterized by eleven logic entries, each for example identified by an index from zero to ten.

For example, these entries have binary values, and correspond to the description as indicated in the table below, in particular for a local control unit (LCU), not shown, of the advanced trackside controller 18.

| Input index | Description |
|---|---|
| 0 | Status of the level passage requested by the interlocking |
| 1 | Lowered status of the first gate K1 of the level passage 102 |
| 2 | Lowered status of the second gate K2 of the level passage 102 |
| 3 | Raised status of the first gate K1 of the level passage 102 |

-continued

| Input index | Description |
|---|---|
| 4 | Raised status of the second gate K2 of the level passage 102 |
| 5 | Status of the LCU logic gate |
| 6 | Status of the LCU nominal mode |
| 7 | Status of the LCU lowering command |
| 8 | Status of the LCU raising command |
| 9 | Stopped status of the LCU |
| 10 | Manual mode |

The logic object corresponding to the level passage amounts to logically associating, via logic rules, a set of binary output values with the set of binary values obtained for the inputs indicated above.

For a level passage comprising two gates, for example a level passage of the English type, eight types of outputs are for example managed by the advanced trackside controller 18, and correspond to the description as indicated in the table below:

| Output index | Description |
|---|---|
| 0 | Status of the level passage obtained |
| 1 | Command of the first red bulb for the different displays of the Level passage |
| 2 | Command of the second red bulb for the different displays of the Level passage |
| 3 | Command of the yellow bulb |
| 4 | Lowering motor command for the first gate group K1 |
| 5 | Lowering motor command for the second gate K2 |
| 6 | Raising motor command for the first gate K1 |
| 7 | Raising motor command for the second gate K2 |

The logic object comprises different combinations, using one or several logic operators, of the different inputs defining different logic conditions that are more or less complex. For example, the AND, OR, IF logic operator.

For example, three first logic conditions are defined with the IF logic operator to test the binary value of the input with index 0 corresponding to the status of the level passage requested by the interlocking system 14, this binary value for example being 00 (default status of the level passage), 01 (raising status requested) or 10 (lowering status requested).

More complex logic conditions consist of testing the value of at least two inputs simultaneously using IF and AND logic operators.

Other, more complex logic conditions for example account for the status of a timer 46 configured to make it possible to monitor and link several statuses of the level passage.

Based on whether these logic conditions are met, different sets of output values are associated. According to this example, a logic rule is, according to the present invention, a bijective association, under a logic condition, that may or may not account for a timer 46, between ten binary input values and eight binary output values.

For example, a logic rule consists of automatically delivering the following output values:

| Output index | Output value |
|---|---|
| 0 | 0 |
| 1 | 2 |

-continued

| Output index | Output value |
|---|---|
| 2 | 2 |
| 3 | 0 |
| 4 | 1 |
| 5 | 1 |
| 6 | 1 |
| 7 | 1 |

by application, by the processor 36 of the trackside controller 18 to the inputs, of the IF and AND logic operators to the following input values, and once a period of 5000 milliseconds has elapsed, measured by the timer 46:

| Input index | Input value |
|---|---|
| 0 | 10 |
| 5 | 0 |
| 6 | 0 |
| 7 | 1 |

Thus, the advanced trackside controller 18 decides with complete autonomy and control that after a period of 5000 milliseconds after having received the four input values above, the status of the level passage is 0, in order to warn motorists and pedestrians of the status change of the level passage, the status of the red bulb of the first gate K1 is 2, i.e., in flash form, the status of the red light of the second gate K2 is also 2, i.e., in flash form, the yellow bulb is off (status value 0), and the motor raising or lowering commands are stopped (i.e., value 1), since the input datum of the logic object is the stop status of the local control unit LCU.

In other words, the advanced trackside controller 18, using at least AND and IF logic operators, fully autonomously verifies the combination of the input values of the logic object corresponding to the level passage and determines the series of steps making it possible to warn motorists or pedestrians of a train's arrival and the imminent closing of the level passage in order to ensure the safety of the railway track.

Based on the changes of input values, the advanced trackside controller 18 is configured to successively execute at least two logic rules of the plurality of logic rules associated with the logic object representative of the level passage.

For example, relative to the level passage example, the advanced trackside controller 18 will execute a first rule consisting of deciding the activation moment of the bulbs in flash mode as described above, then initiating the lowering movement of the gates.

Depending on the complexity of the logic conditions associated with each logic rule, the processor 36 is, according to one particular aspect of the invention, also configured to simultaneously execute at least two logic rules of the plurality of logic rules associated with the logic object representative of at least one piece of trackside equipment or a plurality of pieces of trackside equipment.

For example, relative to the level passage example, the processor 36 simultaneously executes two separate logic rules, one being dedicated to managing the bulbs and the other to managing the gates.

This aspect of simultaneous execution of two logic rules is also implemented by the processor 36 when the logic object has a hierarchical ranking and comprises at least two logic blocks representative of two separate parts of the trackside equipment and/or two separate pieces of trackside equipment.

For example, the processor 36 simultaneously executes a logic rule associated with the switch on the one hand and a logic rule associated with signals on the other hand.

One can thus see that the invention allows great modularity, allowing the advanced trackside controller 18 for trackside equipment to be adapted based on specificities of the operator of the railway network or the country or region of installation of the railway network.

Additionally, the advanced trackside controller 18 makes it possible to ease the data volume and the logic processing carried out within the interlocking system 14.

Furthermore, the autonomy of the trackside controllers 18 obtained according to the invention makes it possible to maintain optimal operation of the actions handled by the advanced trackside controller 18, even in the downgraded mode resulting from a communication defect between the advanced trackside controller 18 and the interlocking system 14.

The invention claimed is:

1. A trackside controller of at least one piece of trackside equipment of a railway network, comprising:

a processor;

a memory unit associated with the processor; and at least one communication port configured to be directly connected to the piece of trackside equipment;

wherein the memory unit comprises a zone dedicated to storing a logic object representative of said at least one piece of trackside equipment, the logic object being executable by the processor and comprising: a plurality of logic rules defining the operation of said at least one piece of trackside equipment and at least two logic blocks representative of two separate parts of said at least one piece of trackside equipment and/or of two separate pieces of trackside equipment.

2. The trackside controller according to claim 1, wherein the processor is configured to execute the logic object from at least one input datum provided by at least one device associated with the trackside controller belonging to the group comprising:

an interlocking system;

a piece of trackside equipment; and another piece of trackside equipment.

3. The trackside controller according to claim 1, wherein the trackside controller comprises a module for defining and/or configuring the logic object.

4. The trackside controller according to claim 1, wherein at least one of the logic rules comprises at least two logic operators.

5. The trackside controller according to claim 1, wherein the processor is configured to successively execute at least two logic rules of the plurality of logic rules associated with the logic object representative of the piece of trackside equipment.

6. The trackside controller according to claim 1, wherein it comprises a timer associated with the processor configured to execute a second logic rule after a first logic rule once a time delay, separating the execution of the first and second logic rules, has elapsed.

7. The trackside controller according to claim 1, wherein the processor is configured to simultaneously execute at least two logic rules of the plurality of logic rules associated with the logic object representative of the piece of trackside equipment.

8. A railway supervision system comprising at least one interlocking system, at least one piece of trackside equipment of a railway network and at least one trackside controller for at least one piece of trackside equipment of a railway network, the trackside controller comprising a housing inside which the processor and the memory unit are arranged, the interlocking system being outside the housing of the trackside controller, wherein said at least one trackside controller is according to claim 1.

9. The railway supervision system according to claim 8, wherein the piece of trackside equipment belongs to the group comprising at least:

a signal;

a switching actuator;

a crossing;

a track circuit; and a sound signal.

10. A trackside controller of at least one piece of trackside equipment of a railway network, comprising:

a processor;

a memory unit associated with the processor; and at least one communication port configured to be directly connected to the piece of trackside equipment;

wherein the memory unit comprises a zone dedicated to storing a logic object representative of said at least one piece of trackside equipment, the logic object being executable by the processor and comprising: a plurality of logic rules defining the operation of said at least one piece of trackside equipment and at least two logic blocks representative of two separate parts of said at least one piece of trackside equipment and/or of two separate pieces of trackside equipment, wherein the processor is configured to simultaneously execute at least two logic rules of the plurality of logic rules associated with the logic object representative of the piece of trackside equipment.

* * * * *